US009101186B2

(12) United States Patent
Lai

(10) Patent No.: US 9,101,186 B2
(45) Date of Patent: Aug. 11, 2015

(54) HARD SHELL LUGGAGE CASE CAPABLE OF EXPANDING CARRYING CAPACITY

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 191 days.

(21) Appl. No.: 13/958,580

(22) Filed: Aug. 4, 2013

(65) Prior Publication Data

US 2015/0034440 A1 Feb. 5, 2015

(51) Int. Cl.

| | |
|---|---|
| ***A45C 7/00*** | (2006.01) |
| *A45C 13/10* | (2006.01) |
| *A45C 5/03* | (2006.01) |

(52) U.S. Cl.

CPC ..... *A45C 7/0027* (2013.01); *A45C 13/103* (2013.01); *A45C 2005/037* (2013.01)

(58) Field of Classification Search

CPC ..... A45C 7/0022; A45C 5/14; A45C 7/0063; A45C 7/0031; A45C 7/0027; A45C 3/02; A45C 3/004; A45C 5/00; A45C 5/02; A44B 19/301

USPC ..... 190/100, 103, 40, 18 R, 18 A, 903, 105, 190/44, 52; 383/907, 2, 97; D3/71, 76, 72, D3/286, 233

See application file for complete search history.

(56) References Cited

U.S. PATENT DOCUMENTS

| | | | | |
|---|---|---|---|---|
| 4,334,601 | A * | 6/1982 | Davis | 224/148.3 |
| 4,733,759 | A * | 3/1988 | Shih-Chen | 190/18 A |
| 4,773,515 | A * | 9/1988 | Kotkins, Jr. | 190/103 |
| 5,671,831 | A * | 9/1997 | Chiu | 190/103 |
| 6,015,072 | A * | 1/2000 | Young | 224/153 |
| 6,220,411 | B1 * | 4/2001 | Scicluna et al. | 190/103 |
| 6,390,259 | B1 * | 5/2002 | Lu | 190/103 |
| 6,408,997 | B1 * | 6/2002 | Chen | 190/103 |
| 6,591,950 | B1 * | 7/2003 | Scicluna | 190/103 |
| 7,641,030 | B2 * | 1/2010 | Selvi | 190/40 |
| 2002/0185350 | A1 * | 12/2002 | Chang et al. | 190/105 |
| 2003/0000784 | A1 * | 1/2003 | Hsu | 190/105 |

* cited by examiner

*Primary Examiner* — Fenn Mathew
*Assistant Examiner* — Cynthia Collado
(74) *Attorney, Agent, or Firm* — Patent Office of Bang Shia

(57) ABSTRACT

A hard shell luggage case capable of expanding carrying capacity includes a case body, a cover, a case-opening zipper, an expansion layer and an expansion zipper. A case-opening zipper controls the closing and opening of the case body and the cover. An expansion zipper controls the closing and opening the expansion layer and the case. The expansion layer and the expansion zipper will be invisible and hidden in the case-opening zipper when the luggage case is in an expanded state and the case-opening zipper is closed, which enhances the aesthetic quality of the luggage case. Furthermore, the hard shell luggage case capable of expanding carrying capacity requires less sewing operations, which makes the luggage case easier to manufacture and reduces manufacturing cost.

3 Claims, 6 Drawing Sheets

HARD SHELL LUGGAGE CASE CAPABLE OF EXPANDING CARRYING CAPACITY

BACKGROUND OF THE INVENTION

1. Field of the Invention

The present invention relates to a hard shell luggage case, and more particularly to a hard shell luggage case capable of expanding carrying capacity.

2. Description of the Prior Art

As shown in FIGS. 1 and 2, a conventional hard shell luggage case which is capable expanding carrying capacity comprises: a case body 11, a cover 12 opposite the case body 11, an expansion layer 13 which is fixed to the cover 12 and located between the case body 11 and the cover 12, a case-opening zipper 14 disposed between the case body 11 and the expansion layer 13, and an expansion zipper 15 disposed between the cover 12 and the case-opening zipper 14. When the case-opening zipper 14 is unzipped, the luggage case will open to receive articles.

As shown in FIG. 1, the expansion zipper 15 is closed, under normal conditions, to bring the cover 12 close to the case body 11. On the contrary, when the user wants on expand the volume and carrying capacity of the luggage case, he/she can pull the expansion zipper 15 open to make the cover 12 move away from the case body 11, so that the expansion layer 13 will be stretched out between the case-opening zipper 14 and the cover 12.

Since the case-opening zipper 14 and the expansion zipper 15 are disposed between the case body 11 and the cover 12 in a series connection manner, the two zippers 14, 15 will always be visible on the luggage case no matter they are pulled open or closed, which is not aesthetic.

On the other hand, the expansion layer 13 and the expansion zipper 15 must have one end sewed together at a sewing part 16 with one end of the case-opening zipper 14, which causes the problems that the sewing part 16 is relatively weak and likely to break, and the luggage case is difficult to manufacture.

The present invention has arisen to mitigate and/or obviate the afore-described disadvantages.

SUMMARY OF THE INVENTION

The primary objective of the present invention is to provide a hard shell luggage case capable of expanding carrying capacity, wherein the expansion layer and the expansion zipper will be invisible and hidden in the case-opening zipper when the luggage case is in an expanded state and the case-opening zipper is closed, which enhances the aesthetic quality of the luggage case.

Another objective of the present invention is to provide a hard shell luggage case capable of expanding carrying capacity, which requires less sewing operations as compared to the conventional luggage case, accordingly reducing manufacturing cost.

To achieve the above objective, a hard shell luggage case capable of expanding carrying capacity in accordance with the present invention comprises: a case body, a cover, a case-opening zipper, an expansion layer and an expansion zipper. The case body has a case-body peripheral edge. The cover is disposed at one side of the case body and includes a cover peripheral edge opposite the case-body peripheral edge. The case-opening zipper is disposed between the case-body peripheral edge and the cover peripheral edge and can be pulled open or closed. When the case-opening zipper is pulled closed, the case body and the cover are brought close to each other, and when the case-opening zipper is pulled open, the case body and the cover are brought away from each other. The expansion layer is flexibly disposed on the cover peripheral edge and located within the case-opening zipper, the expansion layer includes a first expansion peripheral edge disposed at the cover peripheral edge and a second expansion peripheral edge which is located opposite to and further away from the cover peripheral edge than the first expansion peripheral edge. The expansion zipper is disposed between the case-body peripheral edge and the second expansion peripheral edge and located within the case-opening zipper and can be pulled open or closed. When the expansion zipper is pulled closed, the expansion layer and the case body are brought close to each other, and when the expansion zipper is pulled open, the expansion layer and the cover are brought away from each other.

Preferably, a distance appears between the case-body peripheral edge and the cover peripheral edge when the case-opening zipper is pulled closed is smaller than a distance appears between the first and second expansion peripheral edges when the expansion layer stretches out.

Preferably, the case-opening zipper includes a first row of case-opening teeth disposed along the case-body peripheral edge, a second row of case-opening teeth disposed along the cover peripheral edge, and two case-opening sliders slidably disposed the first and second rows of case-opening teeth to bring together or separate the first and second rows of case-opening teeth, the expansion zipper includes a first row of expansion teeth disposed along the case-body peripheral edge, a second row of expansion teeth disposed at the second expansion peripheral edge, and two expansion sliders slidably disposed between the first and second rows of expansion teeth to bring together or separate the first and second rows of expansion teeth.

DETAILED DESCRIPTION OF THE PREFERRED EMBODIMENTS

Figure 1:
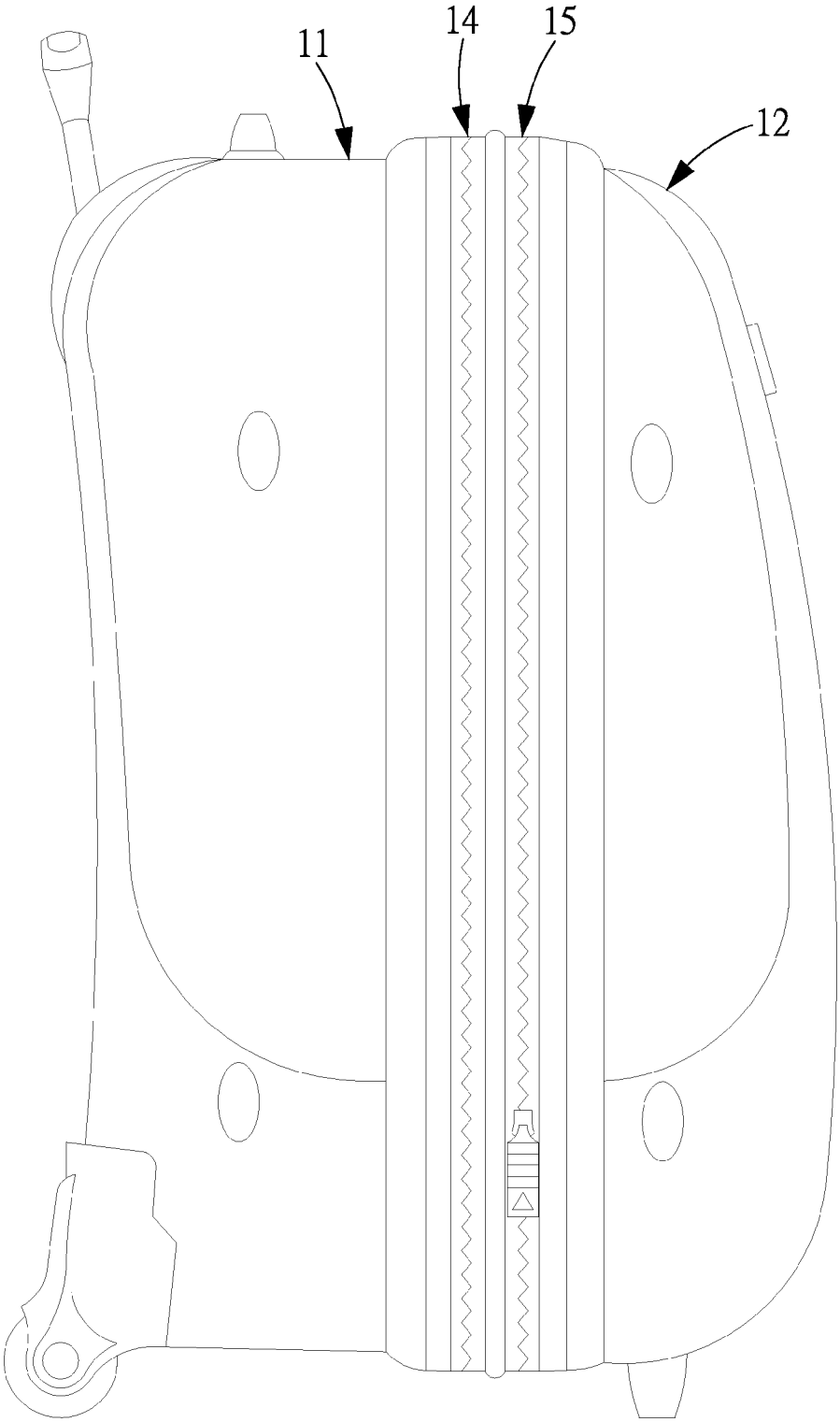
FIG.1 PRIOR ART
FIG. 1 is a side view of a conventional hard shell luggage case capable of expanding carrying capacity.
Figure 2:
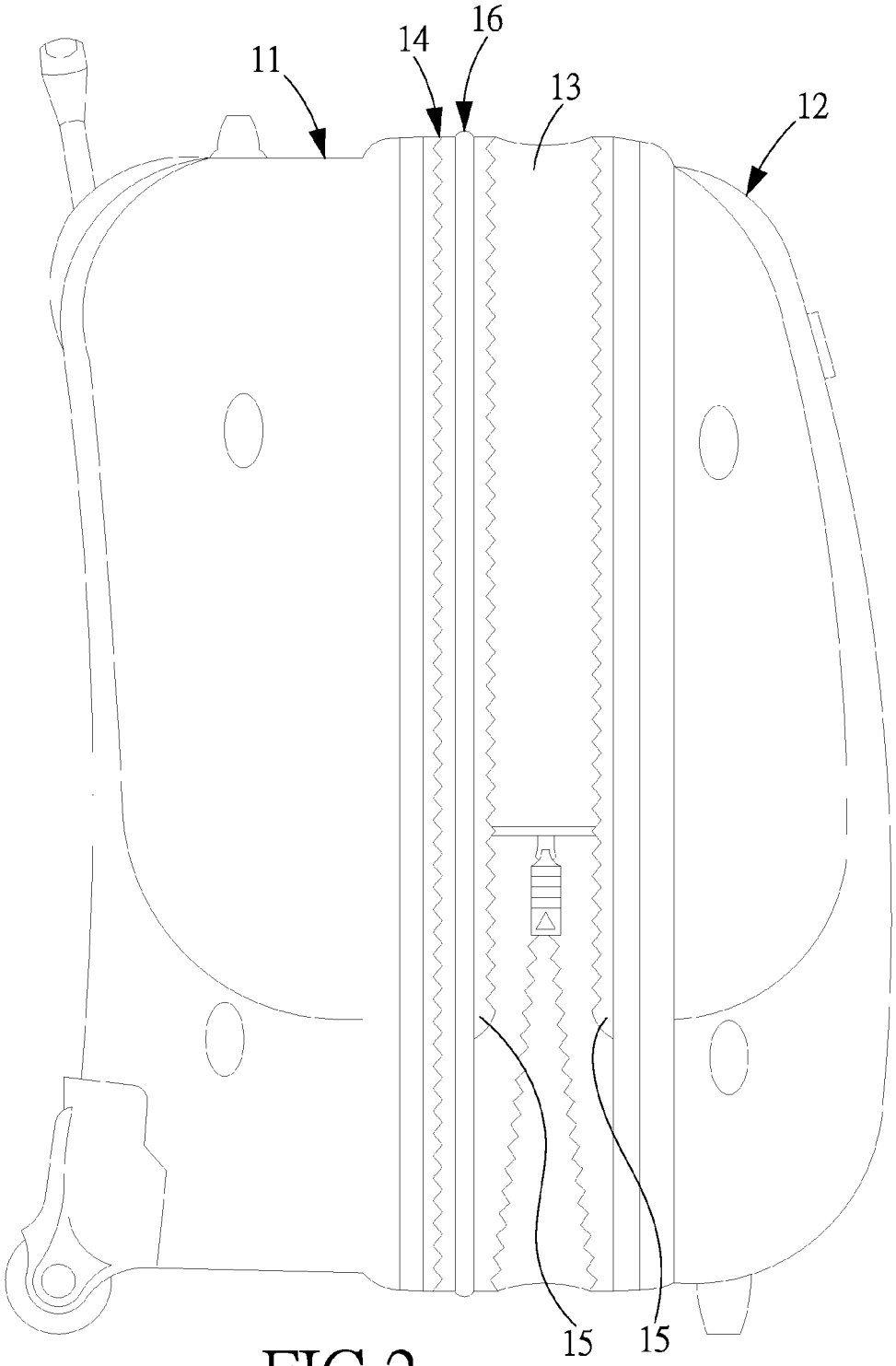
FIG.2 PRIOR ART
FIG. 2 is another side view showing the expanded state of the conventional hard shell luggage case capable of expanding carrying capacity.

The present invention will be clearer from the following description when viewed together with the accompanying drawings, which show, for purpose of illustrations only, the preferred embodiment in accordance with the present invention.

Referring to FIGS. 3-6, a hard shell luggage case capable of expanding carrying capacity in accordance with the present invention comprises: a case body 20, a cover 30, a case-opening zipper 40, an expansion layer 50 and an expansion zipper 60.

The case body 20 includes a case-body peripheral edge 21. In this embodiment, the case body 20 is provided at the top with a handle 22 and two wheels 23 at the bottom thereof. At the back of the case body 20 is provided an extensible rod 24, and at a lateral side of the case body 20 is disposed a locking device 25 to lock the case-opening zipper 40 or the expansion zipper 60. It is to be noted that the extensible rod 24 and the locking device 25 are of conventional art, further descriptions would be omitted here.

The cover 30 is disposed at one side of the case body 20 and includes a cover peripheral edge 31 opposite the case-body peripheral edge 21. In this embodiment, at the bottom of the cover 30 are disposed two wheels 32.

Figure 3:
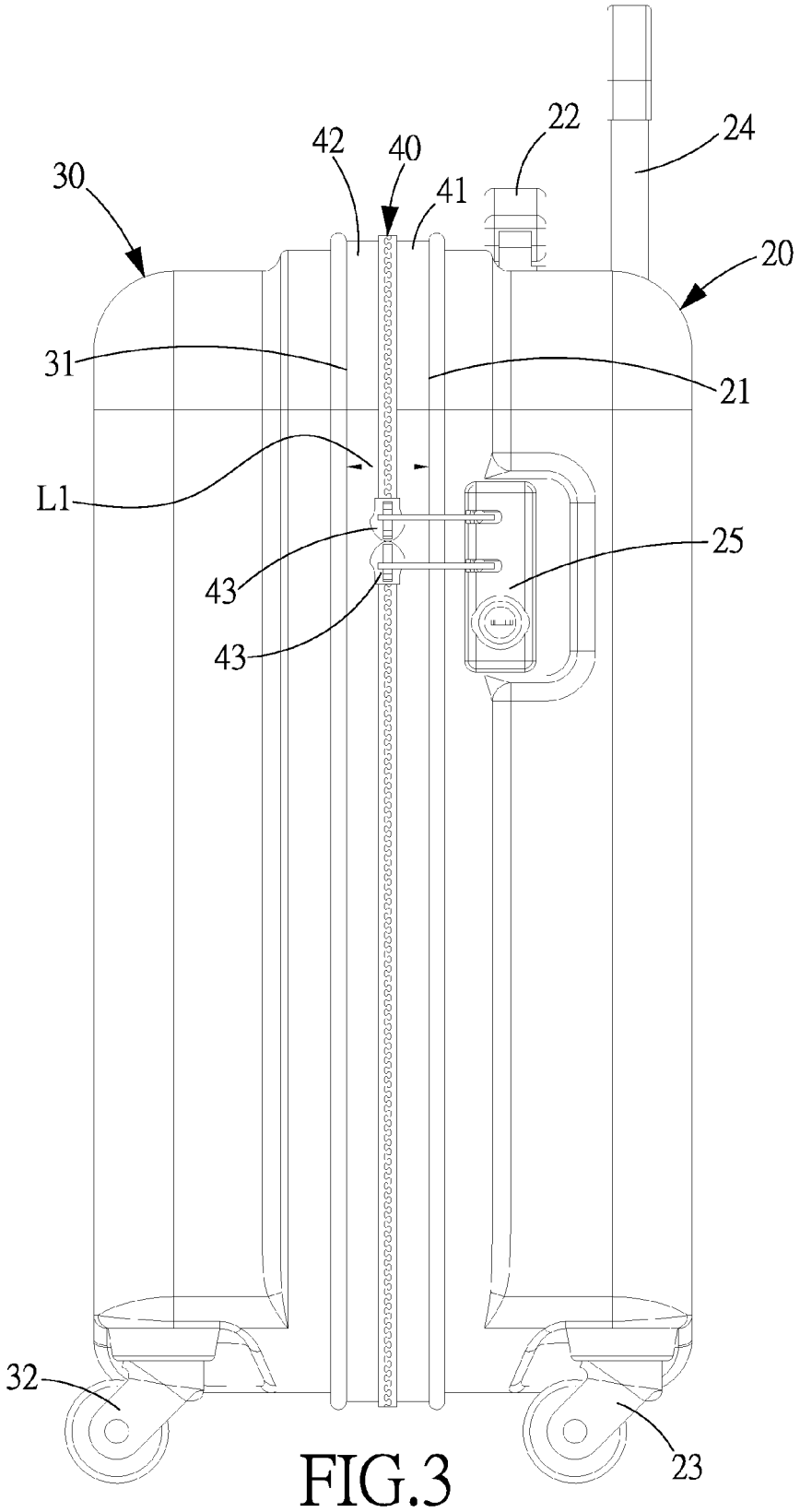
FIG. 3 is a side view of a hard shell luggage case capable of expanding carrying capacity in accordance with the present invention, wherein the case-opening zipper is pulled closed.
Figure 4:
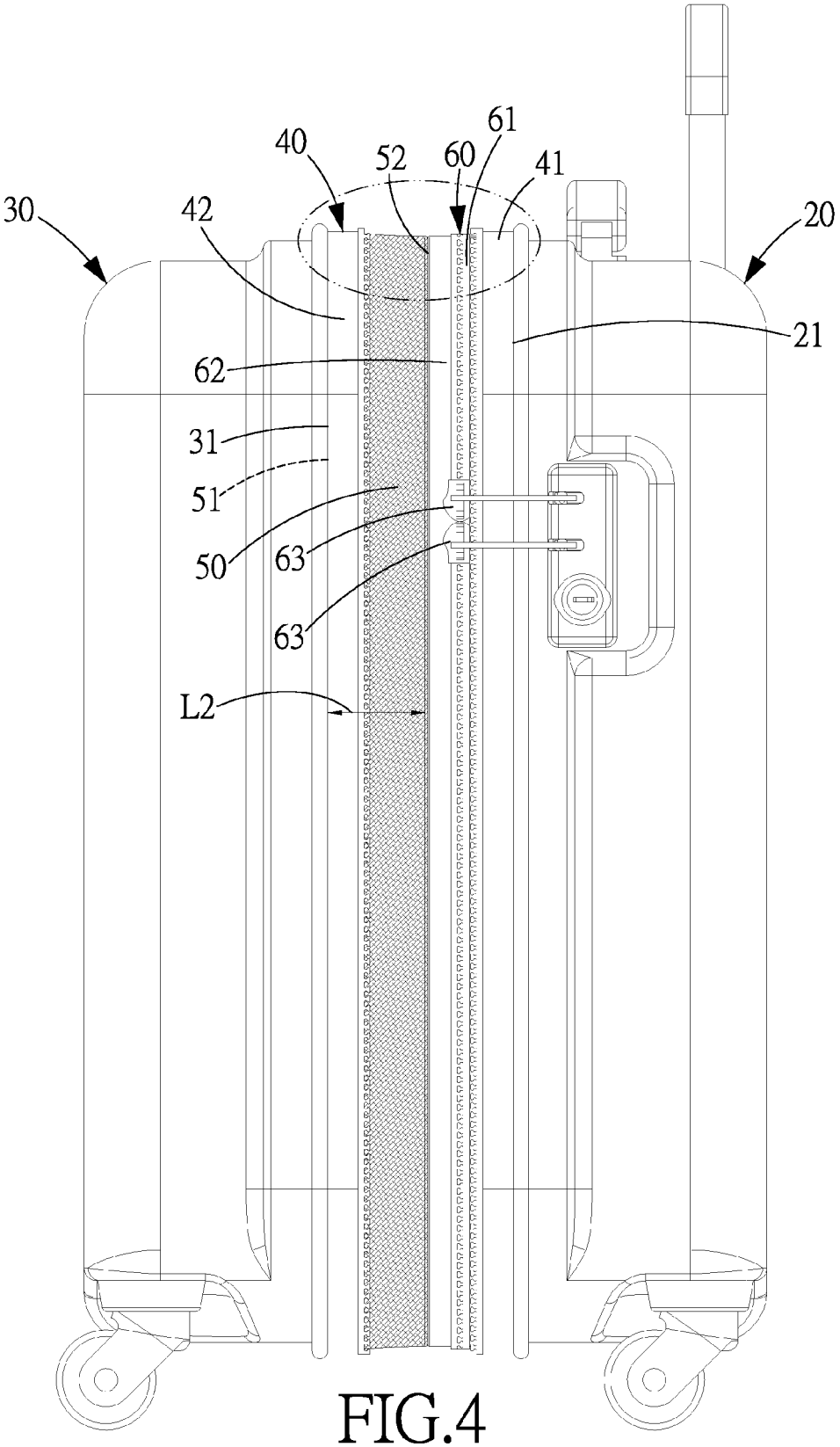
FIG. 4 is a side view of the hard shell luggage case capable of expanding carrying capacity in accordance with the present invention, wherein the case-opening zipper is pulled open, and the expansion zipper is closed.
Figure 5:
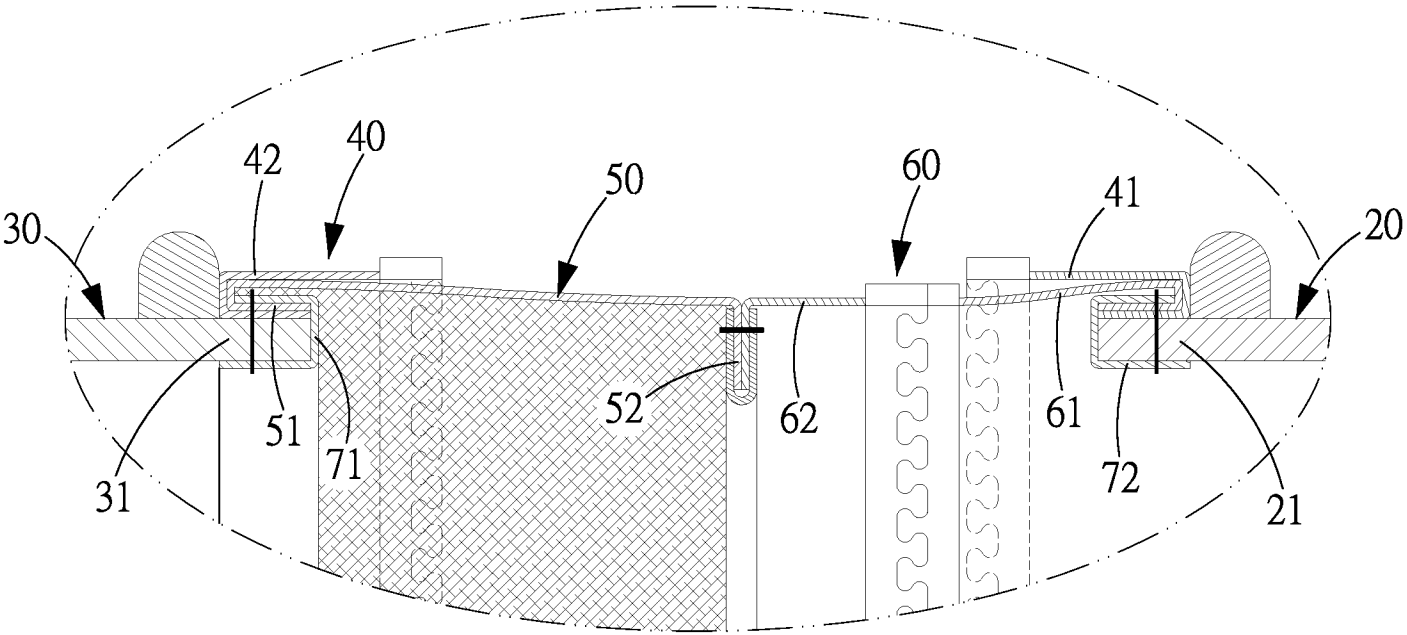
FIG. 5 is an enlarged view of a part of FIG. 4.

The case-opening zipper 40 is disposed between the case-body peripheral edge 21 and the cover peripheral edge 31 and can be pulled between a closed position and an open position. When the case-opening zipper 40 is pulled to a closed position (as shown in FIG. 3), the case body 20 and the cover 30 are brought close to each other, and when the case-opening zipper 40 is pulled to an open position (as shown in FIG. 4), the case body 20 and the cover 30 are brought away from each other. In this embodiment, the case-opening zipper 40 includes a first row of case-opening teeth 41 disposed along the case-body peripheral edge 21, a second row of case-opening teeth 42 disposed along the cover peripheral edge 31, and two case-opening sliders 43 slidably disposed the first and second rows of case-opening teeth 41, 42 to bring together or separate the first and second rows of case-opening teeth 41, 42.

The expansion layer 50 is flexibly disposed on the cover peripheral edge 31 and located within the case-opening zipper 40. The expansion layer 50 has a first expansion peripheral edge 51 disposed at the cover peripheral edge 31 and a second expansion peripheral edge 52 which is located opposite to and further away from the cover peripheral edge 31 than the first expansion peripheral edge 51. It is to be noted that the first expansion peripheral edge 51 and the second row of case-opening teeth 42 are sewed together to the cover peripheral edge 31 and then are covered by a cover 71. A distance L1 (as shown in FIG. 3) appears between the case-body peripheral edge 21 and the cover peripheral edge 31 when the case-opening zipper 40 is pulled to a closed position is smaller than a distance L2 (as shown in FIG. 4) appears between the first and second expansion peripheral edges 51, 52 when the expansion layer 50 stretches out.

Figure 6:
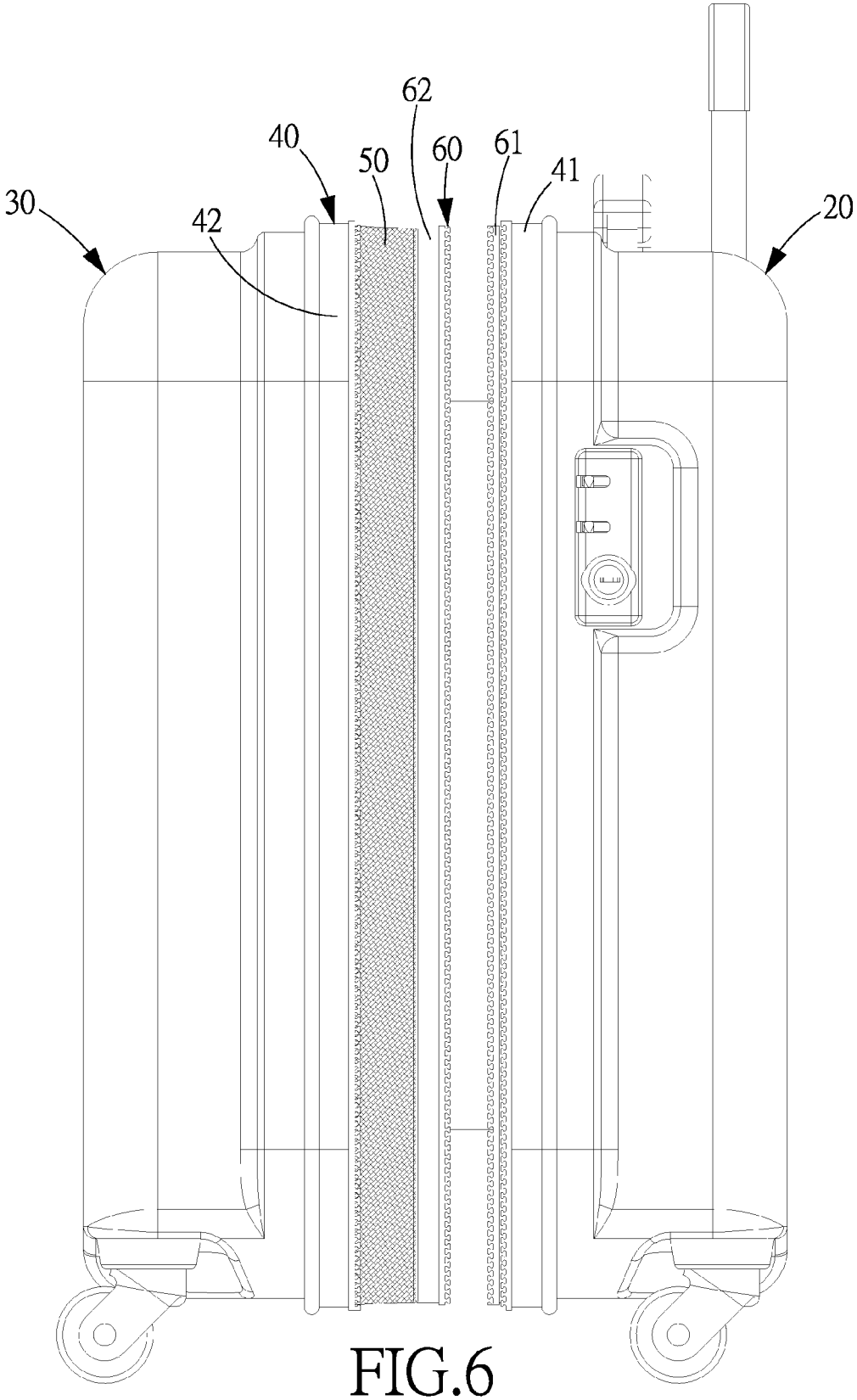
FIG. 6 is a side view of the hard shell luggage case capable of expanding carrying capacity in accordance with the present invention, wherein the case-opening and expansion zippers are pulled open.

The expansion zipper 60 is disposed between the case-body peripheral edge 21 and the second expansion peripheral edge 52 and located within the case-opening zipper 40 and can be pulled between a closed position and an open position. When the expansion zipper 60 is pulled to a closed position (as shown in FIG. 4), the expansion layer 50 and the case body 20 are brought close to each other, and when the expansion zipper 60 is pulled to an open position (as shown in FIG. 6), the expansion layer 50 and the case body 20 are brought away from each other. In this embodiment, the expansion zipper 60 includes a first row of expansion teeth 61 disposed along the case-body peripheral edge 21 and located within the first row of case-opening teeth 41, a second row of expansion teeth 62 disposed at the second expansion peripheral edge 52, and two expansion sliders 63 slidably disposed between the first and second rows of expansion teeth 61, 62 to bring together or separate the first and second rows of expansion teeth 61, 62. It is to be noted that the first row of expansion teeth 61 and the first row of case-opening teeth 41 are sewed together to the case-body peripheral edge 21 and covered by another cover 72.

The carrying capacity of the luggage case in accordance with the present invention can be used in an unexpanded manner, and at the unexpanded state, the user can pull the case-opening zipper 40 open (as shown in FIG. 4) to move the cover 30 and the case body 20 from each other, then pull the expansion zipper 60 open (as shown in FIG. 6) to make the expansion layer 50 and the cover 30 move away from the case body 20, at this moment, the luggage case is opened to allow the user to put belongings into the luggage case or take out belongings, and then the user can pull the case-opening zipper 40 closed (as shown in FIG. 3) to bring the cover 30 and the case body 20 close to each other.

The carrying capacity of the luggage case in accordance with the present invention can also be used in an expanded manner, and at the expanded state, the user pulls the case-opening zipper 40 open (as shown in FIG. 4) to move the cover 30 and the case body 20 from each other, then stretches the expansion layer 50 out between the cover 30 and the expansion zipper 60, then pulls the expansion zipper 60 open (as shown in FIG. 6) to open the luggage case, so that the user's belongings can be put into or removed from the luggage case, after that, the user pulls the case-opening zipper 40 open (as shown in FIG. 4) to bring the expansion layer 50 and the cover 30 close to the case body 20.

Since the expansion layer 50 and the expansion zipper 60 are located within the scope of the case-opening zipper 40, they will be invisible and hidden in the case-opening zipper 40 when the luggage case is in an expanded state and the case-opening zipper 40 is closed, which enhances the aesthetic quality of the luggage case.

Furthermore, the first row of expansion teeth 61 of the expansion zipper 60 is sewed together with the first row of case-opening teeth 41 of the case-opening zipper 40 to the case-body periphery edge 21, the first expansion peripheral edge 51 of the expansion layer 50 is sewed together with the second row of case-opening teeth 42 of the case-opening zipper 40 to the cover peripheral edge 31, and the second row of expansion teeth 62 of the expansion zipper 60 is directly sewed at the second expansion peripheral edge 52 of the expansion layer 50. Therefore, the luggage case of the present invention requires less sewing operations as compared to the conventional luggage case, accordingly reducing manufacturing cost.

In addition, the first and second rows of case-opening teeth 41, 42 of the case-opening zipper 40 are directly sewed at the case-body peripheral edge 21 and the cover peripheral edge 31, the first row of expansion teeth 61 of the expansion zipper 60 is directly sewed at the case-body peripheral edge 21, the second row of expansion teeth 62 of the expansion zipper 60 is directly sewed at the second row of expansion teeth 52 of the expansion layer 50, and the first expansion peripheral edge 51 of the expansion layer is direction sewed to the cover peripheral edge 31. Therefore, the case-opening zipper 40 and the expansion zipper 60 are not connected in a series manner to avoid the existence of weak sewing part, and accordingly the present invention has a relatively strong structure as compared to the convention luggage case where the case-opening zipper and the expansion zipper are arranged in a series manner.

It is to be noted that when the luggage case of the present invention is in an unexpanded state and the expansion zipper 60 and the case-opening zipper 40 are pulled closed, the luggage case can provide a better protection to the belongings contained therein due to the fact that even if the case-opening zipper 40 is broken when the hard shell luggage case of the present invention is subjected to impact during transportation, the expansion zipper 60 is still closed to maintain the hard shell luggage case of the present invention in a closed state, preventing objects from falling out.

While we have shown and described various embodiments in accordance with the present invention, it is clear to those skilled in the art that further embodiments may be made without departing from the scope of the present invention.

What is claimed is:

1. A hard shell luggage case capable of expanding carrying capacity, comprising:

a case body with a case-body peripheral edge;

a cover disposed at one side of the case body and including a cover peripheral edge opposite the case-body peripheral edge;

a case-opening zipper disposed between the case-body peripheral edge and the cover peripheral edge and capable of being pulled open or closed, when the case-opening zipper is pulled closed, the case body and the cover are brought close to each other, and when the case-opening zipper is pulled open, the case body and the cover are brought away from each other;

an expansion layer flexibly disposed on the cover peripheral edge and located within the case-opening zipper, the expansion layer including a first expansion peripheral edge disposed at the cover peripheral edge and a second expansion peripheral edge which is located opposite to and further away from the cover peripheral edge than the first expansion peripheral edge;

an expansion zipper disposed between the case-body peripheral edge and the second expansion peripheral edge and located within the case-opening zipper and capable of being pulled open or closed, when the expansion zipper is pulled closed, the expansion layer and the case body are brought close to each other, and when the expansion zipper is pulled open, the expansion layer and the cover are brought away from each other.

2. The hard shell luggage case capable of expanding carrying capacity as claimed in claim 1, wherein a distance appears between the case-body peripheral edge and the cover peripheral edge when the case-opening zipper is pulled closed is smaller than a distance appears between the first and second expansion peripheral edges when the expansion layer stretches out.

3. The hard shell luggage case capable of expanding carrying capacity as claimed in claim 1, wherein the case-opening zipper includes a first row of case-opening teeth disposed along the case-body peripheral edge, a second row of case-opening teeth disposed along the cover peripheral edge, and two case-opening sliders slidably disposed the first and second rows of case-opening teeth to bring together or separate the first and second rows of case-opening teeth, the expansion zipper includes a first row of expansion teeth disposed along the case-body peripheral edge, a second row of expansion teeth disposed at the second expansion peripheral edge, and two expansion sliders slidably disposed between the first and second rows of expansion teeth to bring together or separate the first and second rows of expansion teeth.

* * * * *